US005998913A

United States Patent [19]

Matsutani

[11] Patent Number: 5,998,913

[45] Date of Patent: Dec. 7, 1999

[54] SPARK PLUG WITH IRIDIUM-RHODIUM ALLOY DISCHARGE PORTION

[75] Inventor: Wataru Matsutani, Nagoya, Japan

[73] Assignee: NGK Spark Plug Co., Ltd., Nagoya, Japan

[21] Appl. No.: 09/040,851

[22] Filed: Mar. 18, 1998

[30] Foreign Application Priority Data

Mar. 18, 1997 [JP] Japan ..... 9-085917
Dec. 25, 1997 [JP] Japan ..... 9-368546

[51] Int. Cl.[6] ..... H01T 13/39

[52] U.S. Cl. ..... 313/141; 313/136

[58] Field of Search ..... 313/136, 141, 313/142; 123/169

[56] References Cited

U.S. PATENT DOCUMENTS

| | | | |
|---|---|---|---|
| Re. 35,429 | 1/1997 | Kondo | 313/141 |
| 4,081,710 | 3/1978 | Heywood et al. | 313/141 |
| 4,771,209 | 9/1988 | Ryan | 313/141 |
| 5,514,929 | 5/1996 | Kawamura | 313/141 |

FOREIGN PATENT DOCUMENTS

| | | | |
|---|---|---|---|
| 0 702 093 | 3/1996 | European Pat. Off. | C22C 5/04 |
| 196 23 795 | 12/1996 | Germany | H01T 13/39 |
| 9-7733 | 1/1997 | Japan | H01T 13/20 |
| 2 302 367 | 1/1997 | United Kingdom | H01T 13/39 |

*Primary Examiner*—Michael Day
*Attorney, Agent, or Firm*—Brinks Hofer Gilson & Lione

[57] ABSTRACT

A spark plug includes a center electrode, an insulator provided outside the center electrode, a metallic shell provided outside the insulator, a ground electrode disposed opposingly to the center electrode, and a spark discharge portion fixed on at least one of the center electrode and the ground electrode for defining a spark discharge gap. The spark discharge portion is formed from an alloy containing Ir as a main component, Rh in an amount of 0.1 wt. % to 35 wt. %, and at least one of Ru and Re in an amount of 0.1 wt. % to 17 wt. %.

20 Claims, 5 Drawing Sheets

SPARK PLUG WITH IRIDIUM-RHODIUM ALLOY DISCHARGE PORTION

BACKGROUND OF THE INVENTION

1. Field of the Invention

The present invention relates to a spark plug used in an internal combustion engine.

2. Description of the Related Art

Conventionally, a spark plug for an internal combustion engine such as an automobile engine employs a Pt (platinum) alloy chip welded to an end of an electrode for use as a spark discharge portion with improved spark consumption resistance. However, due to expensiveness and a relatively low melting point of 1769° C., platinum is not satisfactory as a spark consumption resistant material for spark plug use. Thus, use of Ir (iridium), which is inexpensive and has a higher melting point of 2454° C., as a material for a chip has been proposed. However, since Ir tends to produce a volatile oxide and be consumed at a high temperature zone ranging from 900° C. to 1000° C., a spark discharge portion formed from Ir involves a problem of consumption stemming from oxidation/volatilization rather than spark consumption. Accordingly, an Ir chip shows good endurance under low temperature conditions as in traveling in an urban area, but has a problem of a significant reduction in endurance in continuous high-speed traveling.

Thus, an attempt has been made to suppress consumption of a chip stemming from oxidation/volatilization of Ir by adding an appropriate element to an alloy used as a material for a chip. For example, Japanese Patent Application Laid-Open (kokai) No. 9-7733 discloses a spark plug whose chip is improved in high-temperature heat resistance and consumption resistance by suppressing oxidation/volatilization of Ir through addition of Rh (rhodium).

However, an Ir—Rh alloy used as a chip material in the above-disclosed spark plug must contain a considerably large amount of Rh against consumption stemming from oxidation/volatilization in a continuous high-speed, high-load operation of an internal combustion engine. Since Rh is several times more expensive than Ir and has a relatively low melting point of 1970° C. as compared with that of Ir, an excessively large Rh content not only pushes up material cost of a chip but also involves insufficient resistance to spark consumption. That is, in recent years, operating conditions of spark plugs tend to become severer in association with an improvement in performance of internal combustion engines. Therefore, when such a chip is made from an Ir—Rh alloy and the Rh content of the alloy is increased considerably, sufficient resistance to spark consumption cannot be attained under certain operating conditions.

The aforementioned publication discloses endurance test results of a spark plug whose chip is formed from an alloy containing an Ir—Rh binary alloy as a base material and a third metal component, such as Pt or Ni, which is added to the base material in a manner of substituting for Ir. However, according to the endurance test results, the amount of consumption of a chip as observed after the endurance test is rather larger than that of a chip formed from an alloy into which neither Pt nor Ni is added, indicating that no improvement is achieved in the consumption resistance of such an Ir—Rh binary alloy.

SUMMARY OF THE INVENTION

An object of the present invention is to provide a spark plug whose spark discharge portion is formed from an Ir—Rh alloy, but shows less susceptibility to consumption stemming from oxidation/volatilization of Ir at high temperatures as compared with a conventional spark plug whose spark discharge portion is formed from an Ir—Rh binary alloy, thereby securing excellent endurance in traveling in an urban area as well as in high-speed traveling.

Another object of the present invention is to provide a spark plug whose spark discharge portion contains a smaller amount of expensive Rh than does a spark discharge portion of a conventional spark plug, thereby reducing cost of manufacture, yet securing good endurance.

According to a first aspect of the present invention, there is provided a spark plug which comprises a center electrode, an insulator provided outside the center electrode, a metallic shell provided outside the insulator, a ground electrode disposed opposingly to the center electrode, and a spark discharge portion fixed on at least one of the center electrode and the ground electrode for defining a spark discharge gap. Also, the spark discharge portion of the spark plug is formed from an alloy containing Ir as a main component, Rh in an amount of 0.1 wt. % to 35 wt. %, and Ru and/or Re in an amount of 0.1 wt. % to 17 wt. %.

According to a second aspect of the present invention, there is provided a spark plug which comprises a center electrode, an insulator provided outside the center electrode, a metallic shell provided outside the insulator, a ground electrode disposed opposingly to the center electrode, and a spark discharge portion fixed on at least one of the center electrode and the ground electrode for defining a spark discharge gap. Also, the spark discharge portion of the spark plug is formed from an alloy containing Ir as a main component, Rh in an amount of 0.1 wt. % to 35 wt. %, and Ru in an amount of 0.1 wt. % to 17 wt. %.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE INVENTION AND PREFERRED EMBODIMENTS

Figure 1:
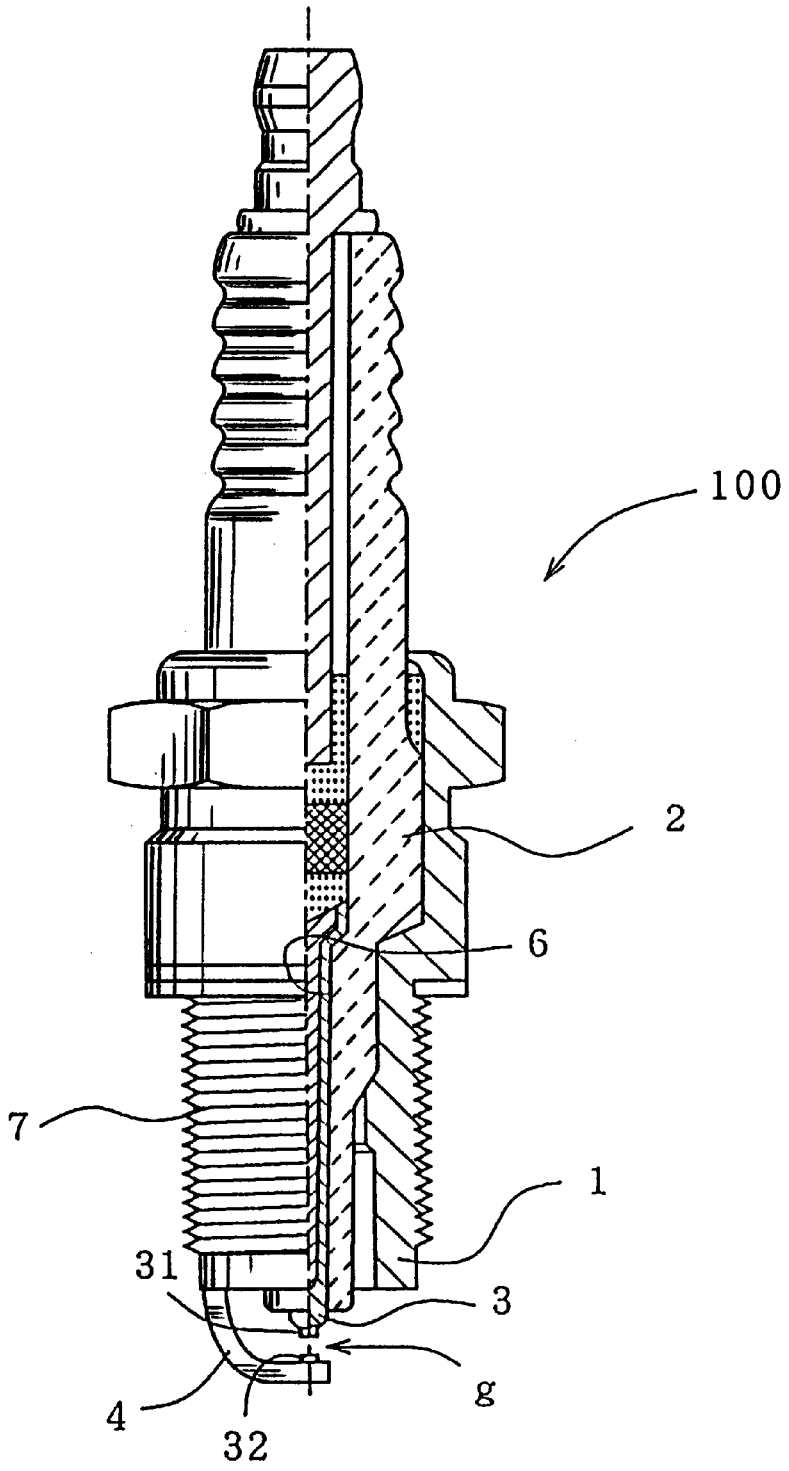
FIG. 1 is a semi-cross-sectional view of a spark plug according to the present invention.

The present inventor has found that a spark discharge portion formed from an alloy that contains Ir as a main component, and contains Rh, and Ru and/or Re in amounts falling within the above-described specific ranges is far less susceptible to consumption stemming from oxidation/volatilization of Ir at high temperatures as compared with a conventional spark discharge portion formed from an Ir—Rh binary alloy, resulting in excellent endurance of a spark plug.

The aforementioned spark discharge portion is formed by welding a chip formed from an alloy having the aforementioned composition to a ground electrode and/or a center electrode. Herein, the "spark discharge portion" denotes the portion of a welded chip that is free from variations in composition caused by welding (i.e. other than the portion of the welded chip which has alloyed with a material of the ground electrode or center electrode due to welding).

In the aforementioned alloy, an Rh content of less than 0.1 wt. % impairs the effect of suppressing oxidation/volatilization of Ir, resulting in failure to secure a required consumption resistance of a spark plug. By contrast, an Rh content in excess of 35 wt. % causes a drop in the melting point of the alloy containing Re or Ru, impairing spark consumption resistance and thus failing to secure sufficient endurance of a spark plug. Thus, the Rh content of the alloy must fall within the aforementioned range.

Meanwhile, when the amount of Ru and/or Re contained in the alloy is less than 0.1 wt. %, the effect of suppressing oxidation/volatilization of Ir attained by addition of Ru and/or Re is impaired. Thus, the advantage of the alloy over the Ir—Rh binary alloy is lost. By contrast, when the amount of Ru and/or Re contained in the alloy is in excess of 17 wt. %, the spark discharge portion is rather susceptible to spark consumption, failing to secure sufficient endurance of a spark plug. Thus, the content of Ru and/or Re is adjusted in the aforementioned range, preferably 0.1 wt. % to 13 wt. %, more preferably 0.5 wt. % to 10 wt. %. Ru and Re may be contained singly or in combination.

Both of Ru and Re may be added in combination, or either one of Ru and Re may be added solely as in the second aspect of the present invention in which only Ru is added.

A conceivable reason for an improvement in consumption resistance of the spark discharge portion effected by addition of Ru and/or Re in the alloy is that the addition of Ru and/or Re causes a fine oxide film stable at high temperatures to be formed at the surface of the alloy, and Ir whose oxide would otherwise be highly volatile is fixedly contained in the oxide film. The oxide film conceivably functions as a passive film, suppressing the progress of oxidation of Ir. As seen from experimental data which will be described later, the addition of Ru and/or Re does not markedly improve the alloy's resistance to oxidation/volatilization at high temperatures unless Rh is added. Thus, the oxide film is conceivably formed of a composite oxide of Ir—M—Rh or the like (where M is one or combination of Ru and Re) and is superior to an oxide film of Ir—M in fineness or adhesion to the surface of the alloy.

When Ru and/or, Re is excessively contained in the alloy, spark consumption rather than volatilization of an Ir oxide conceivably progresses. That is, when the Ru and/or Re content of the alloy is excessive, fineness or adhesion to the alloy surface of a formed oxide film reduces. This adverse effect is particularly marked when Ru and/or Re is contained in the alloy in excess of 17 wt. %. In addition, upon exposure to repeated impact of a spark discharge of a spark plug, the formed oxide film tends to exfoliate, causing the surface of the alloy to be exposed and thus allowing progressive spark consumption.

The addition of Ru and/or Re achieves the following important effect. As compared with a conventional spark plug whose spark discharge portion is formed from an Ir—Rh binary alloy, a spark plug whose spark discharge portion is formed from an Ir—Rh alloy containing Ru and/or Re achieves a significant reduction in the Rh content of the alloy with a resultant reduction of cost of manufacture, yet secures sufficient consumption resistance and high performance.

In the first and second aspects of the present invention, the Rh content of the alloy is preferably adjusted to fall within the range of 0.1 wt. %–5 wt. %.

According to the aforementioned Japanese Patent Laid-Open (kokai) No. 9-7733, the amount of Rh contained in a spark discharge portion or chip is adjusted to fall within the range of 1 wt. %–60 wt. %, preferably 3 wt. %–30 wt. %. As described in the Example section of the publication, a chip formed from an Ir—Rh binary alloy containing Rh in an amount of less than 1 wt. % shows lack of consumption resistance, and even a chip formed from an Ir—Rh binary alloy containing Rh in an amount of 1 wt. % to 3 wt. % does not necessarily achieve optimum consumption resistance. However, even in the above-described composition range in which sufficient consumption resistance is considered to be difficult to attain, addition of Ru and/or Re enables a chip to have consumption resistance equivalent to or better than that of the conventional chip formed from an Ir—Rh binary alloy.

Among various methods of evaluating an oxidation consumption characteristic of the spark discharge portion, a method employed by the present invention is as follows: a disk-shaped test piece having a diameter of 0.7 mm and a thickness of 0.5 mm is formed from an alloy used as material for the spark discharge portion and allowed to stand at 1100° C. for 30 hours in the atmosphere; then, a reduction in weight of the test piece (hereinafter referred to as oxidation loss) is measured. The composition of an alloy used as material for the spark discharge portion may be selected such that an oxidation loss is 20% or less. When an oxidation loss exceeds 20%, the spark discharge portion may fail to secure a required consumption resistance. The composition of the alloy is selected preferably such that an oxidation loss is 10% or less, particularly 5% or less.

An alloy used as material for the spark discharge portion may contain an oxide (including a composite oxide) of a metallic element of group 3A (so-called rare earth elements) or 4A (Ti, Zr, and Hf) of the periodic table in an amount of 0.1 wt. % to 15 wt. %. The addition of such an oxide more effectively suppresses consumption of Ir stemming from oxidation/volatilization of Ir. When the oxide content is less than 0.1 wt. %, the effect of adding the oxide against oxidation/volatilization of Ir is not sufficiently achieved. By contrast, when the oxide content is in excess of 15 wt. %, the thermal shock resistance of a chip is impaired; consequently, the chip may crack, for example, when the chip is fixed to an electrode through welding or the like. Preferred examples of the oxide include $Y_2O_3$ as well as $LaO_3$, $ThO_2$, and $ZrO_2$.

Next, embodiments of the present invention will now be described with reference to the drawings.

Figure 2:
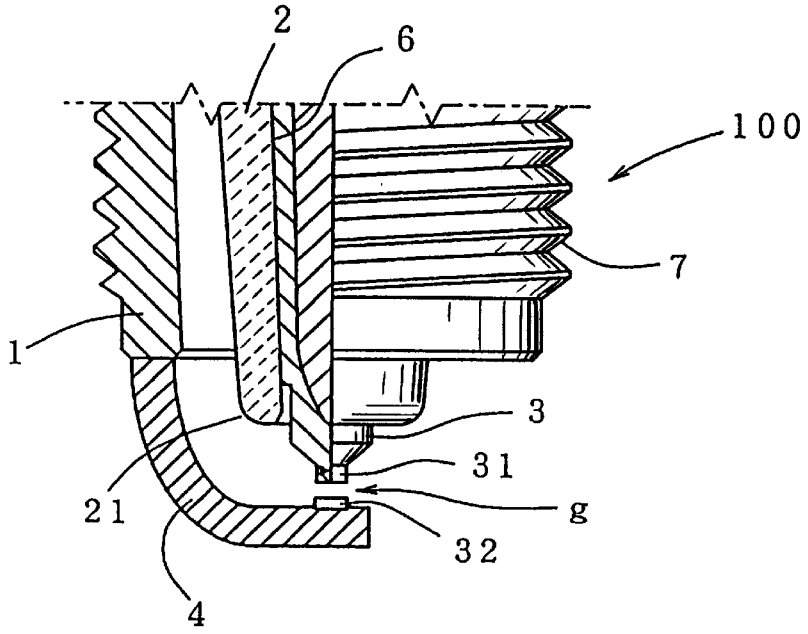
FIG. 2 is a partial cross-sectional view of the spark plug of FIG. 1, showing the spark discharge portion and the vicinity thereof.

As shown in FIGS. 1 and 2, a spark plug 100 includes a cylindrical metallic shell 1, an insulator 2, a center electrode 3, and a ground electrode 4. The insulator 2 is inserted into the metallic shell 1 such that a tip portion 21 of the insulator 2 projects from the metallic shell 1. The center electrode 3 is fittingly provided in the insulator 2 such that a spark discharge portion 31 formed at a tip of the center electrode 3 is projected from the insulator 2. One end of the ground electrode 4 is connected to the metallic shell 1 by welding or like method, while the other end of the ground electrode 4 is bent sideward, facing the tip of the center electrode 3. As shown in FIG. 2, a spark discharge portion 32 is formed on the ground electrode 4 opposingly to the spark discharge portion 31. The spark discharge portions 31 and 32 define a spark discharge gap g therebetween.

The insulator 2 is formed from a sintered body of ceramics such as alumina ceramics or aluminum-nitride ceramics and has a hollow portion 6 formed therein in an axial direction of the insulator 2 for receiving the center electrode 3. The metallic shell 1 is tubularly formed from metal such as low carbon steel and has threads 7 formed on the outer circumferential surface and used for mounting the spark plua 100 to an engine clock (not shown).

Bodies portions 3*a* and 4*a* of the center electrode 3 and ground electrode 4, respectively, are formed from a Ni alloy or like metal. The opposingly disposed spark discharge portions 31 and 32 are formed from an alloy containing Ir as a main component, Rh in an amount of 0.1 wt. % to 35 wt. %, preferably 0.1 wt. % to 5 wt. %, and Ru and/or Re (for example, Ru) in an amount of 0.1 wt. % to 17 wt. %, preferably 0.1 wt. % to 13 wt. %, and more preferably 0.5 wt. % to 10 wt. %.

Figure 3:
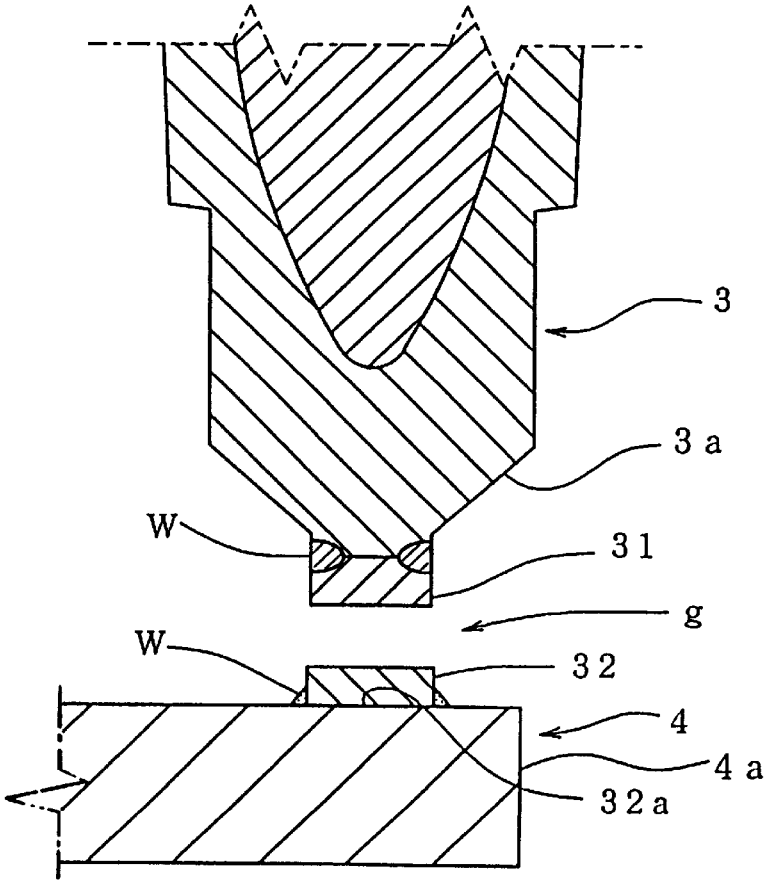
FIG. 3 is an enlarged cross-sectional view of essential portions of FIG. 2.

As shown in FIG. 3, the tip portion of the body 3*a* of the center electrode 3 is reduced in diameter toward the tip of the tip portion and has a flat tip face. A disk-shaped chip formed from the alloy described above as material for the spark discharge portion 31 is placed on the flat tip face. Subsequently, a weld zone W is formed along the outer circumference of the boundary between the chip and the tip portion by laser welding, electron beam welding, resistance welding, or like welding, thereby fixedly attaching the chip onto the tip portion and forming the spark discharge portion 31. Likewise, a chip is placed on the ground electrode 4 in a position corresponding to the spark discharge portion 31; thereafter, a weld zone W is formed along the outer circumference of the boundary between the chip and the ground electrode 4, thereby fixedly attaching the chip onto the ground electrode 4 and forming the spark discharge portion 32. These chips may be formed from a non-sintered alloy material or a sintered alloy material. The non-sintered alloy material is manufactured by mixing alloy components, melting them, and allowing to solidify. The sintered alloy material is manufactured by forming a green from powder of an alloy having the above-described composition or from a mixture powder of component metals mixed to obtain the above-described composition, and by sintering the green.

Either the spark discharge portion 31 or the spark discharge portion 32 may be omitted. In this case, the spark discharge gap g is formed between the spark discharge portion 31 and the ground electrode 4 or between the center electrode 3 and the spark discharge portion 32.

Next, the action of the spark plug 100 will be described. The spark plug 100 is mounted to an engine block by means of the threads 7 and used as an igniter for a mixture fed into a combustion chamber. Since the spark discharge portions 31 and 32, which are opposed to each other to form the spark discharge gap g therebetween, are formed from the aforementioned alloy, the consumption of the spark discharge portions 31 and 32 stemming from oxidation/volatilization of Ir is suppressed, and the spark consumption resistance of the spark discharge portions 31 and 32 is also improved through effective use of a material having a high melting point. Accordingly, the spark discharge gap g does not increase over a long period of use, thereby extending the service life of the spark plug 100.

EXAMPLES

Example 1

Figure 4:
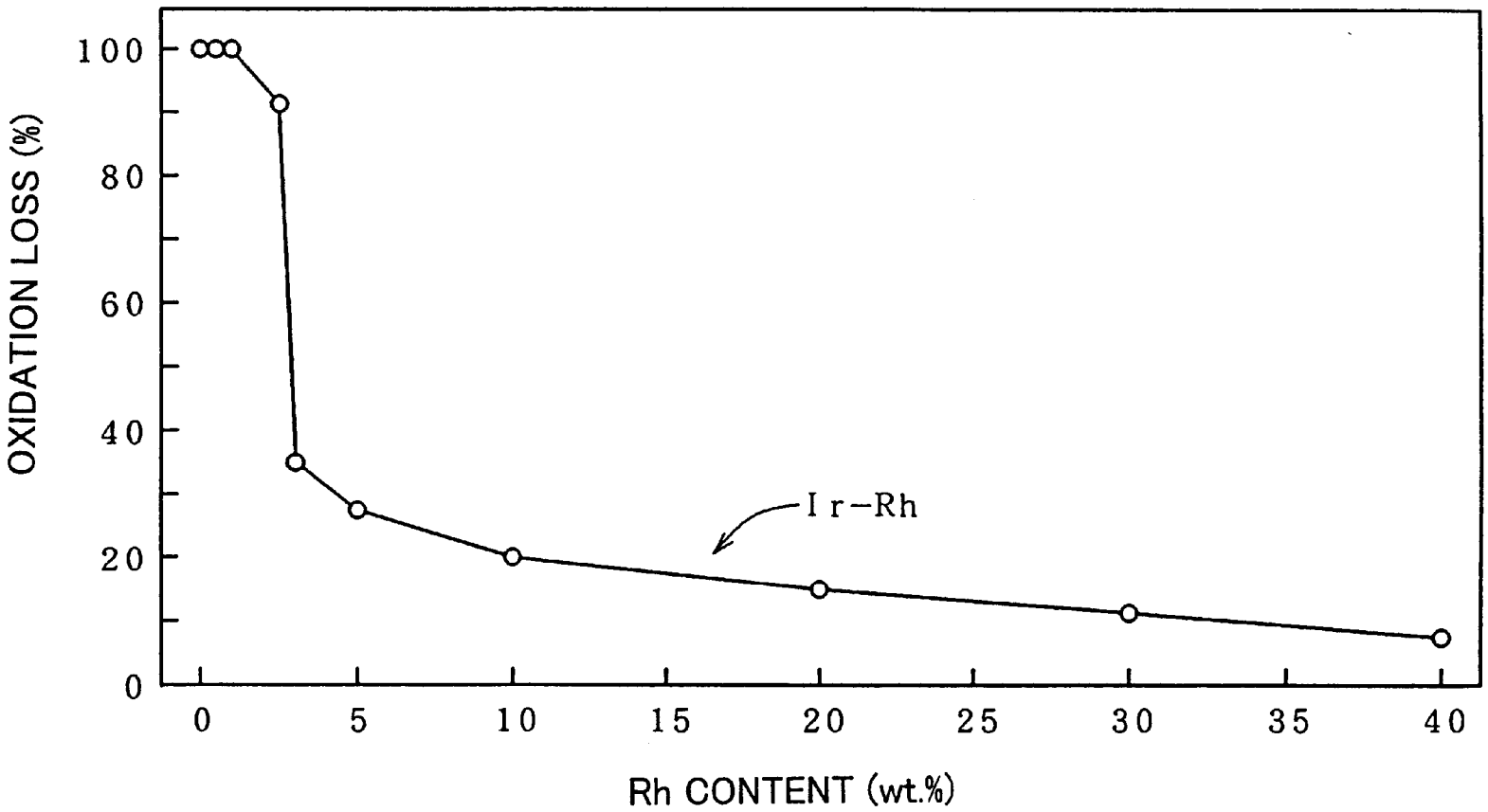
FIG. 4 is a graph showing the relation between oxidation loss and Rh content for test pieces formed from an Ir—Rh alloy in Example 1.
Figure 5:
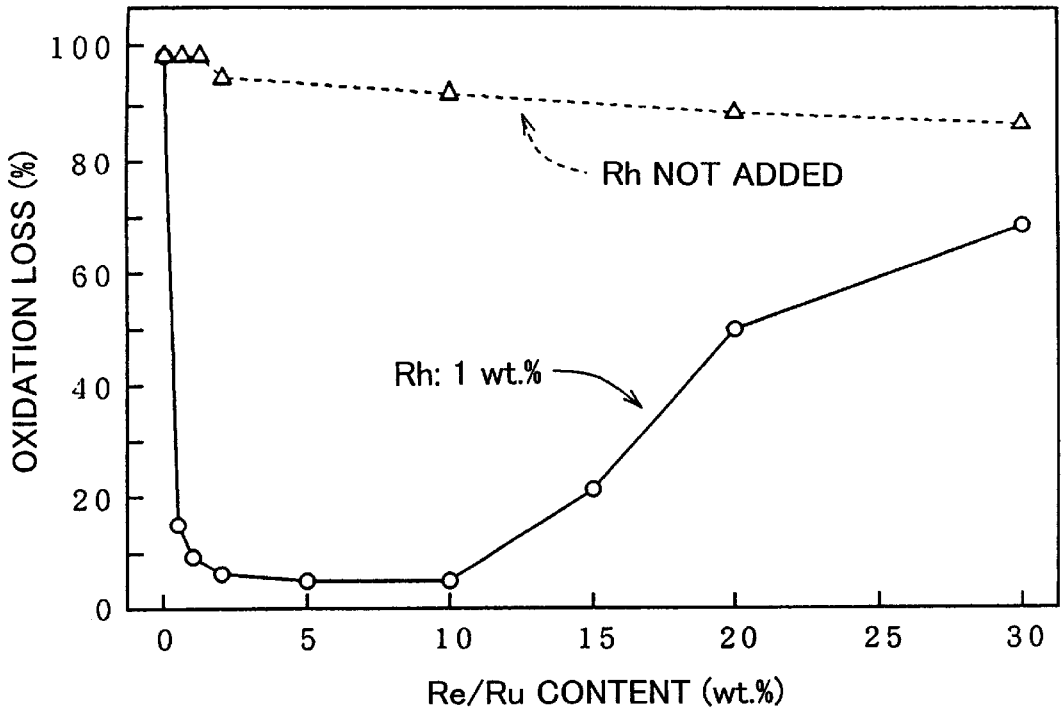
FIG. 5 is a graph showing the relation between oxidation loss and Re or Ru content for test pieces formed from an Ir—Rh—Re or Ir—Rh—Ru alloy containing Rh in an amount of 1 wt. % in Example 1.
Figure 6:
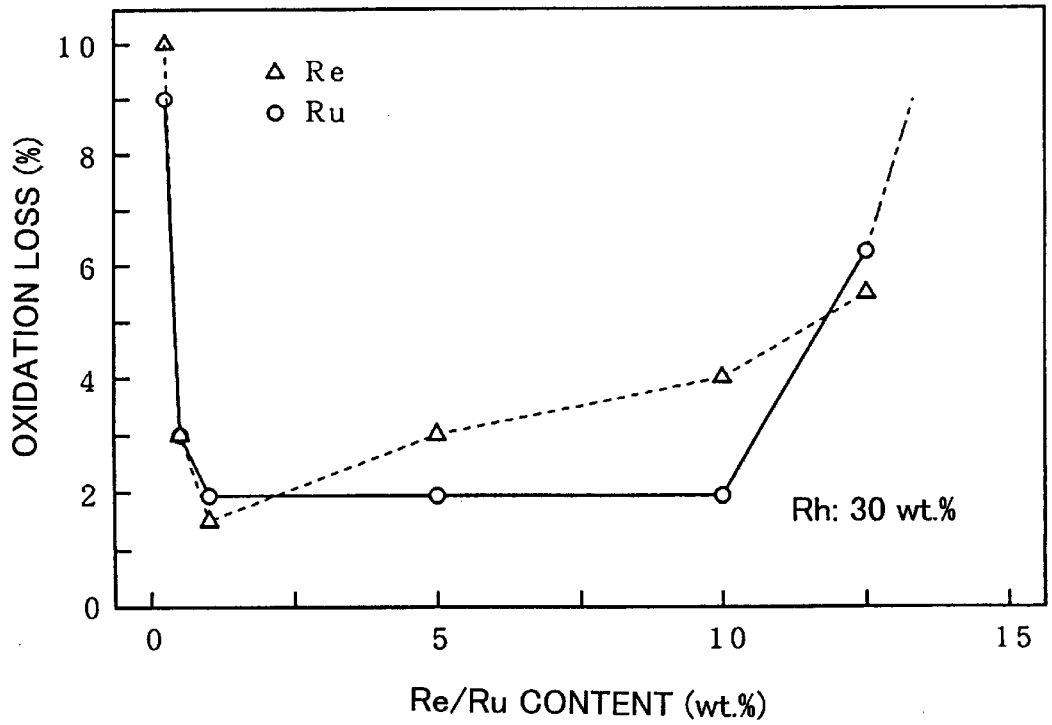
FIG. 6 is a graph showing the relation between oxidation loss and Re or Ru content for test pieces formed from an Ir—Rh—Re or Ir—Rh—Ru alloy containing Rh in an amount of 30 wt. % in Example 1.

Alloys containing Ir as a main component, Rh, and Re and/or Ru in various proportions were manufactured by mixing Ir, Rh, and Re and/or Ru in predetermined amounts and melting the resulting mixtures. The thus-obtained alloys were machined into disk-shaped chips, each having a diameter of 0.7 mm and a thickness of 0.5 mm. The pieces were used as test chips. These chips were allowed to stand at 1100° C. for 30 hours in the atmosphere and were then each measured for a reduction in weight (oxidation loss). The results are shown in FIGS. 4 to 6. FIG. 4 shows the relation between oxidation loss and Rh content for test pieces formed from an Ir—Rh binary alloy. At an Rh content of not less than 3 wt. %, an oxidation loss is relatively small, indicating that an Ir—Rh binary alloy is applicable to the spark discharge portion of a spark plug. By contrast, at an Rh content of less than 3 wt. %, an oxidation loss sharply increases, indicating that a problem of poor consumption resistance will arise.

FIG. 5 shows the relation between oxidation loss and Re or Ru content for test pieces formed from an Ir—Rh—Re or Ir—Rh—Ru alloy containing Rh in an amount of 1 wt. %. Re and Ru were singly added, and Ir—Rh—Re and Ir—Rh—Ru alloys showed no particular difference in the relation between oxidation loss and their content. In the graph FIG. 5, the results of addition of Re as well as Ru are shown in a superposed manner. When Re or Ru is not added (corresponding to an Rh content of 1 wt. % in FIG. 4), an oxidation loss is almost 100%. When Re or Ru is added even in a very small amount, an oxidation loss sharply decreases: not greater than 20% at an Re or Ru content of not less than 0.5 wt. %; not greater than 10% at an Re or Ru content of not less than 1 wt. %. This level of oxidation loss is equivalent to or better than that achieved in the case where the Rh content was increased to 20 wt. % or more in the test for the Ir—Rh binary array, the results of which are shown in FIG. 4. The results of FIG. 5 indicate that spark plug chips formed from an Ir—Rh—Re or Ir—Rh—Ru alloy containing a small amount of Re or Ru are highly resistant to consumption even in high-speed, high-load operation, improving endurance of a spark plug. However, when an Re or Ru content is in excess of 10 wt. %, an oxidation loss begins to increase. At an Re or Ru content in excess of 17 wt. %, an oxidation loss increases to approximately 40%, raising a problem of poor consumption resistance for a spark discharge portion.

In FIG. 5, the test results of an alloy to which Rh was not added are shown by a dashed line. The test results indicate that the addition of Re or Ru achieves no remarked improvement in oxidation loss. This means that the effect of improving the resistance of an alloy to consumption stemming from oxidation/volatilization is achieved only when Rh and Re or Rh and Ru are added in combination; in other words, Rh and Re or Rh and Ru are in an inseparable relation.

FIG. 6 shows the relation between oxidation loss and Re or Ru content for test pieces formed from an Ir—Rh—Re or Ir—Rh—Ru alloy containing Rh in an amount of 30 wt. %. An Ir—Rh—Re or Ir—Rh—Ru alloy containing an Re or Ru in an amount of, for example, 0.5 wt. % to 10 wt. % reduces an oxidation loss to approximately ⅓ through ¾ as compared with that of an Ir—Rh binary alloy to which Re or Ru is not added.

Example 2

Alloys containing Ir as a main component, Rh, and Re and/or Ru in various proportions were manufactured by mixing Ir, Rh, and Re and/or Ru in predetermined amounts and melting the resulting mixtures. The thus-obtained alloys were machined into disk-shaped chips, each having a diameter of 0.7 mm and a thickness of 0.5 mm. The pieces were used as test chips.

Ru and Re were added in the alloy in accordance with six different sets of addition conditions; i.e., the total content of Ru and Re was fixed to 10 wt. % or 0.5 wt. %, and only Ru was added, only Re was added, or Ru and Re were both added. For each set of addition conditions, the content of Rh was changed stepwise within the range of 0 to 40 wt. % (however, 0 wt. % was reserved for the Comparative Example). For comparison, chips were manufactured from an alloy to which neither Re or Ru was added and in which the content of Rh was changed stepwise within the range of 0 to 40 wt. %.

Figure 7:
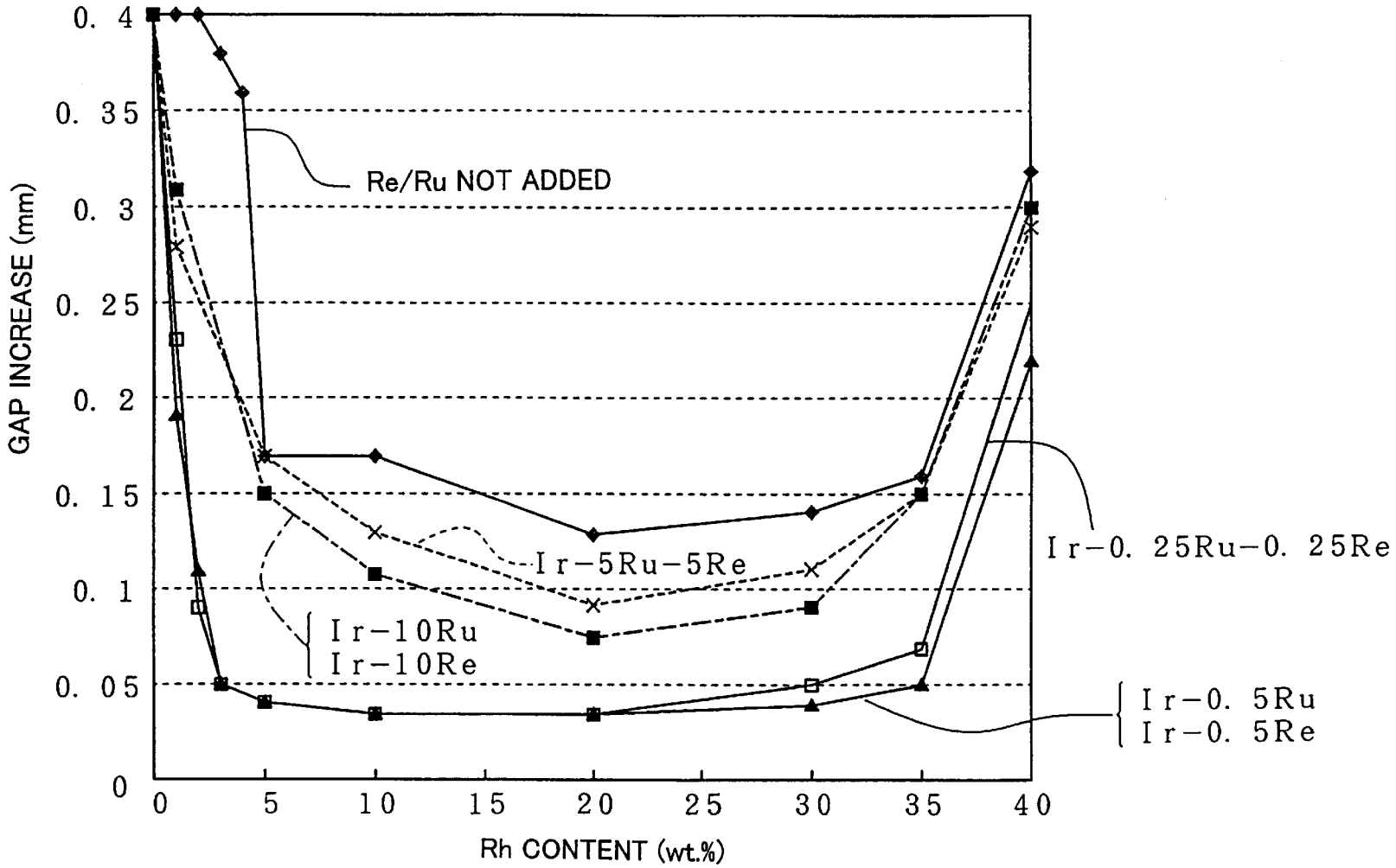
FIG. 7 is a graph showing the relation between a spark discharge gap increase and the Rh content of an alloy used as material for a spark discharge portion.

The thus-manufactured chips were used to form the opposingly disposed spark discharge portions 31 and 32 of the spark plug 100 shown in FIG. 2. The Re or Ru content of an alloy was 0.5 wt. % and 10 wt. %. The spark discharge gap g was set to 1.1 mm. The performance of the thus-formed spark plugs was tested on a 6-cylinder gasoline engine (piston displacement: 3000 cc) under the following conditions: throttle completely opened, engine speed 5500 rpm, and 400-hour continuous operation (center electrode temperature: approx. 900° C.). After the test operation, the spark plugs were measured for an increase in the spark discharge gap g. FIG. 7 shows the relation between an increase in spark discharge gap and the Rh content of an alloy.

As seen from FIG. 7, spark discharge portions formed from an Ir—Rh alloy to which Re and/or Ru is added in an amount of 0.5 wt. % or 10 wt. % exhibit, at any Rh content, consumption resistance equivalent to or better than that of spark discharge portions formed from an Ir—Rh binary alloy which contains neither Re nor Ru, regardless of the addition condition, i.e, addition of Ru only, addition of Re only, or combined addition of Ru and Re. For example, in the case where the total amount of Re and Ru is 0.5 wt. %, excellent wear resistance is stably obtained in a wide composition range in which the content of Rh varies within the range of 5 to 35 wt. %. Particularly, spark discharge portions formed from the Ir—Rh binary alloy, which contains neither Re or Ru, show a sharp impairment in consumption resistance at an Rh content of less than 5 wt. %, whereas spark discharge portions formed from an Ir—Rh alloy containing Re and/or Ru maintain higher consumption resistance compared to the spark discharge portions formed from the Ir—Rh binary alloy, even at an Rh content of less than 5 wt. %.

Obviously, numerous modifications and variations of the present invention are possible in light of the above teachings. It is therefore to be understood that within the scope of the appended claims, the present invention may be practiced otherwise than as specifically described herein.

The present disclosure relates to subject matter contained in Japanese Patent Application Nos. HEI 9-85917 (filed on Mar. 18, 1997) and HEI 9-368546 (filed on Dec. 25, 1997).

What is claimed is:

1. A spark plug comprising:

a center electrode;

an insulator provided outside said center electrode;

a metallic shell provided outside said insulator;

a ground electrode disposed opposingly to said center electrode; and a spark discharge portion fixed on at least one of said center electrode and said ground electrode for defining a spark discharge gap, wherein said spark discharge portion is formed from an alloy containing Ir as a main component, Rh in an amount of 0.1 wt. % to 35 wt. %, and at least one of Ru and Re in an amount of 0.1 wt. % to 17 wt. %.

2. The spark plug according to claim 1, wherein at least one of Ru and Re is contained in an amount of 0.1 wt. % to 13 wt. %.

3. The spark plug according to claim 2, wherein at least one of Ru and Re is contained in an amount of 0.5 wt. % to 10 wt. %.

4. The spark plug according to claim 1, wherein Rh is contained in an amount of 0.1 wt. % to 5 wt. %.

5. The spark plug according to claim 4, wherein at least one of Ru and Re is contained in an amount of 0.1 wt. % to 13 wt. %.

6. The spark plug according to claim 5, wherein at least one of Ru and Re is contained in an amount of 0.5 wt. % to 10 wt. %.

7. The spark plug according to claim 4 further comprising a metal oxide of Group 3A or 4A or a composite thereof in an amount of 0.1 wt. % to 15 wt. %.

8. The spark plug according to claim 7, wherein the metal oxide is selected from the group $Y_2O_3$, $LaO_3$, $ThO_2$ and $ZrO_2$.

9. The spark plug according to claim 1 further comprising a metal oxide of Group 3A or 4A or a composite thereof in an amount of 0.1 wt. % to 15 wt. %.

10. The spark plug according to claim 9, wherein the metal oxide is selected from the group $Y_2O_3$, $LaO_3$, $ThO_2$ and $ZrO_2$.

11. A spark plug comprising:

a center electrode;

an insulator provided outside said center electrode;

a metallic shell provided outside said insulator;

a ground electrode disposed opposingly to said center electrode; and a spark discharge portion fixed on at least one of said center electrode and said ground electrode for defining a spark discharge gap, wherein said spark discharge portion is formed from an alloy containing Ir as a main component, Rh in an amount of 0.1 wt. % to 35 wt. %, and Ru in an amount of 0.1 wt. % to 17 wt. %.

12. The spark plug according to claim 11, wherein Ru is contained in an amount of 0.1 wt. % to 13 wt. %.

13. The spark plug according to claim 12, wherein Ru is contained in an amount of 0.5 wt. % to 10 wt. %.

14. The spark plug according to claim 11, wherein Rh is contained in an amount of 0.1 wt. % to 5 wt. %.

15. The spark plug according to claim 14, wherein Ru is contained in an amount of 0.1 wt. % to 13 wt. %.

16. The spark plug according to claim 15, wherein Ru is contained in an amount of 0.5 wt. % to 10 wt. %.

17. The spark plug according to claim 14 further comprising a metal oxide of Group 3A or 4A or a composite thereof in an amount of 0.1 wt. % to 15 wt. %.

18. The spark plug according to claim 17, wherein the metal oxide is selected from the group $Y_2O_3$, $LaO_3$, $ThO_2$ and $ZrO_2$.

19. The spark plug according to claim 11 further comprising a metal oxide of Group 3A or 4A or a composite thereof in an amount of 0.1 wt. % to 15 wt. %.

20. The spark plug according to claim 19, wherein the metal oxide is selected from the group $Y_2O_3$, $LaO_3$, $ThO_2$ and $ZrO_2$.

* * * * *